US005984170A

United States Patent [19]

Scheuren

[11] Patent Number: 5,984,170

[45] **Date of Patent: *Nov. 16, 1999**

[54] TEAR STRING ENVELOPE

[75] Inventor: Axel Walter Scheuren, Buchholz, Germany

[73] Assignee: J. G. Hambrock-Edition, Hamburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/950,540

[22] Filed: Oct. 15, 1997

Related U.S. Application Data

[63] Continuation of application No. 08/501,134, filed as application No. PCT/EP94/00444, Feb. 16, 1994, abandoned.

[30] Foreign Application Priority Data

| | | | |
|---|---|---|---|
| Feb. 17, 1993 | [DE] | Germany | 93 02 248 U |
| Dec. 24, 1993 | [DE] | Germany | 93 19 909 U |

[51] Int. Cl.[6] ..... B65D 27/38

[52] U.S. Cl. ..... 229/310; 229/311; 229/313

[58] Field of Search ..... 229/309, 310, 229/311, 312

[56] References Cited

U.S. PATENT DOCUMENTS

| | | | |
|---|---|---|---|
| 1,035,109 | 8/1912 | Wasmus | 229/312 X |
| 1,385,493 | 7/1921 | Putney . | |
| 1,773,671 | 8/1930 | Glass | 229/311 |
| 1,821,011 | 9/1931 | Greenlaw . | |
| 2,051,939 | 8/1936 | Day . | |
| 2,056,472 | 10/1936 | Lewis | 229/312 X |
| 2,162,958 | 6/1939 | MacDonald | 229/309 |
| 2,644,634 | 7/1953 | Weitzner | 229/310 |
| 2,954,916 | 10/1960 | Mela . | |
| 2,956,727 | 10/1960 | Chevan et al. . | |
| 3,139,231 | 6/1964 | Hueschen . | |
| 3,489,068 | 1/1970 | Dziemczyk | 229/312 X |
| 4,781,296 | 11/1988 | Morris et al. . | |

FOREIGN PATENT DOCUMENTS

| | | | |
|---|---|---|---|
| 634457 | 1/1962 | Canada | 229/309 |
| 499674 | 2/1920 | France | 229/310 |
| 20 51 939 | 5/1971 | Germany . | |
| 3224872 | 1/1984 | Germany | 229/311 |
| 128174 | 6/1919 | United Kingdom | 229/311 |
| 2160172 | 12/1985 | United Kingdom | 229/310 |
| 8503039 | 7/1985 | WIPO | 229/309 |

*Primary Examiner*—Jes F. Pascua
*Attorney, Agent, or Firm*—Vidas, Arrett & Steinkraus, P.A.

[57] ABSTRACT

A tear string envelope with the envelope made of an integral blank of sheet material and formed such that the front and rear portion of the envelope is interconnected by side flaps folded inwardly so that side edges and a lower and an upper folding edge are formed under leaving an upper insertion opening which can be closed by a gummed closing flap. The tear string extends at the inner side of an edge, with the tear string adhered at an edge different from that of the closing flap.

4 Claims, 2 Drawing Sheets

TEAR STRING ENVELOPE

This application is a continuation of application Ser. No. 08/501,134, filed Sep. 19, 1995, now abandoned which is a national stage of PCT/EP94/00444 filed Feb. 16, 1994.

The invention refers to a tear string envelope.

BACKGROUND OF THE INVENTION

Envelopes having a cutting or tear string can be opened easier and more safely and protect the contents better than conventional envelopes. A string or strip is extended in the interior of the envelope adjacent to an edge with one end thereof extending outwardly. By lateral tearing of the string away from the envelope, the envelope can be opened in a defined manner without necessitating an additional tool.

An envelope of the kind mentioned above is known by the U.S. Pat. No. 1,385,493 wherein the cutting string is fixed by a gumming at a folding line different from that of the closing flap. One end of the cutting string is extended outwardly and attached to a flap which can be fixed to the outer side of the envelope, e.g. by gumming.

From the U.S. Pat. No. 2,956,727 an envelope has become known wherein at one folding line a tear string is disposed defined by a flat strip which is fixed at one end portion by an adhesive. The tear string is also extended outwardly of the envelope at one end thereof and attached to the outer side by an adhesive. From the U.S. Pat. No. 2,954,916 it is also known to use a flat strip as tear string.

From the U.S. Pat. No. 3,139,231 a tear string for an envelope has become known which string is extended outwardly of the envelope to a larger extent. A seal or the like is attached to the outer portion of the string for a fixation of the string on the exterior of the envelope. The seal or the flap which has a characteristic contour is sized such that a printing thereon is possible.

From the U.S. Pat. No. 1,821,011 an envelope-like package for powder-like substances has become known which is made of an integral blank of paper. First, a flat hose is formed by a wall portion and two side flaps, with a tear string partially coated with an adhesive is deposited under tension thereon in order to press the hose against an underground. Thereafter, the bottom flap which is gummed is folded about the tautly tensioned string against the side flaps. Thereafter, the tear string is cut. The tear string thus is separated from the contents of the package manufactured.

The object of the invention is to design a tear string envelope such that the tear string can be deposited during the manufacture of the envelope in a simple manner.

SUMMARY OF THE INVENTION

According to the invention, the positioning and attaching of the cutting string takes place contemporarily with the manufacture of the blank for the envelope or the manufacture of the envelope from the blank, respectively, in that the cutting string is impregnated or coated with an adhesive. A slow down of the process velocity is avoided. The additional expense for the apparatus is minimal. The device can be simply integrated in the existing manufacturing machines since the attachment of the string already takes place in the existing machine. After attachment of the string and curing of the adhesive, the latter must be have a sufficient elasticity in order to not affect the usual performance of an envelope. The positioning of the self-adherent or pressure-sensitive string has the advantage that the string prior to its positioning and cutting may run through an impregnating device. In particular, if the string is positioned in the envelope such that upon manufacture of the envelope the string lies in feeding direction, the string can be fed endlessly and cut to respective lengths. The cutting can be carried out when the string has been already positioned. By the adhesive effect, the string retains itself on the attained location and does not affect the following folding of the flaps and the further processing of the envelopes.

The described processing of the string has the further advantage that the cutting string is safely retained up to the final folding and thus prevented from dropping out of the envelope. Furthermore, the string is tautly positioned which is advantageous for the tearing process.

The extension of the cutting string in the area of the attachment of the side flaps along the associated edge guarantees a definite position of the cutting string prior to the opening of the envelope, a satisfactory transfer of the tearing forces during the opening of the envelope and enables a complete opening by tearing or cutting the associated edge of the envelope.

In an embodiment of the invention one end of the cutting string is extended beyond the side edge of the envelope. Alternatively, the string can be adhered at one end thereof. The extended end can be attached by a point- or strip-like sticker or a cured drop of an adhesive substance which covers the preferably taut string. The exposed end portion of the string can be completely covered by an adhesive strip. Such an exposed end of a strip facilitates the gripping thereof. An attachment of the exposed string portion adjacent to the end thereof enables the user to simply recognize and grip the strip and protects the string during handling and transportation. The attachment of the string by an adhesive point or strip can be also used for advertisement purposes which automatically draws the attention of the user.

The other end of the string can be also selectively extended outwardly or remains in the adhesive area of the side flap (3). In the latter case, a deflection or an extension towards the adhesive area is possible. According to a further embodiment of the invention, the cutting edge of the envelope is perforated to support the cutting effect of the string.

According to a further embodiment of the invention, the string is formed such that it is not thicker than the folding edge of the envelope. This can be carried out by a respective selection of the string material or by a band having a thickness smaller than that of the folding edge, with the larger surfaces of the band extending parallel to the surfaces of the envelope.

BRIEF DESCRIPTION OF THE DRAWING

An embodiment example of the invention is subsequently described along a drawing.

FIG. 3 shows an embodiment in which the band is covered by and adhesive tape.

DESCRIPTION OF THE PREFERRED EMBODIMENT(S)

Figure 1:
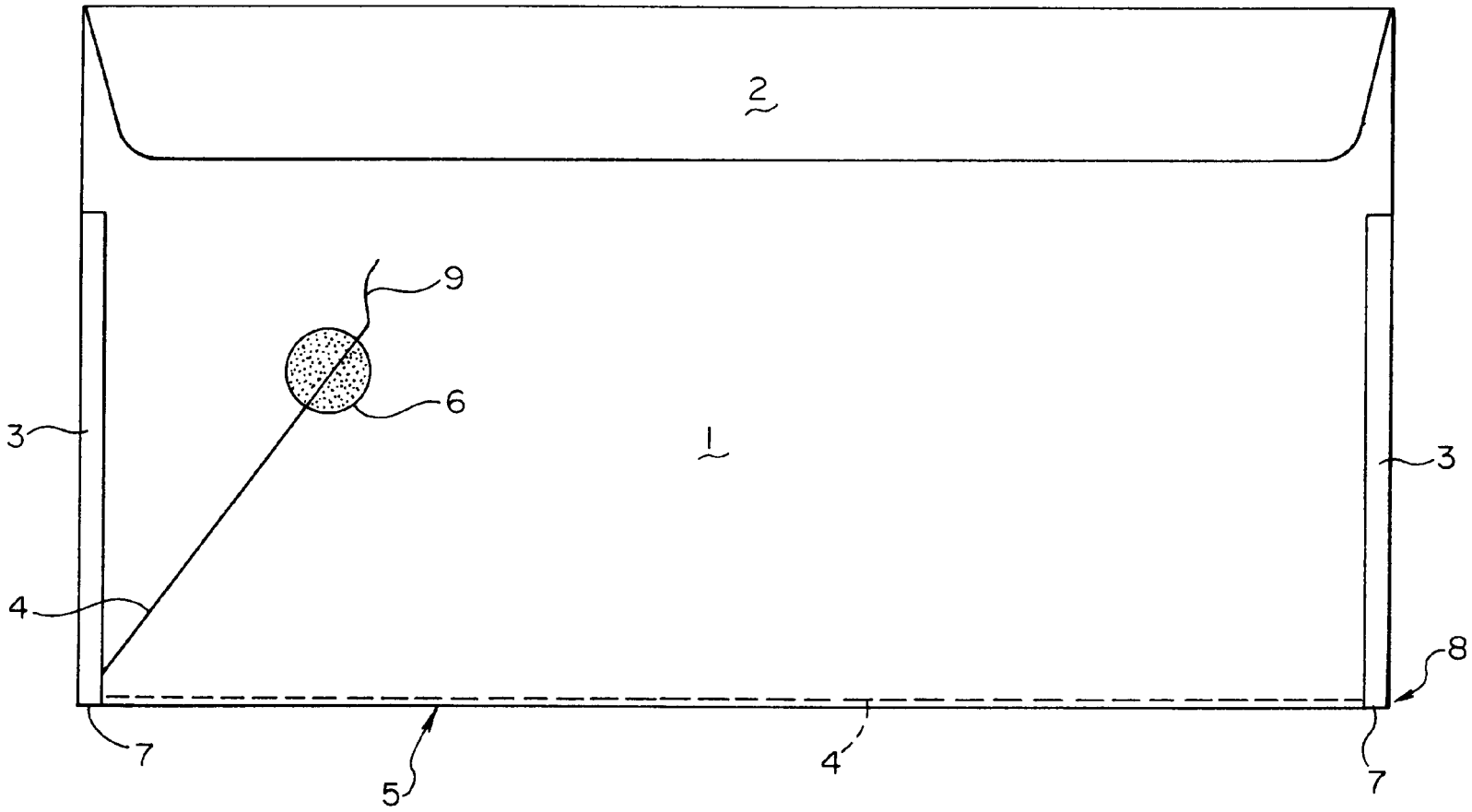
FIG. 1 shows the rear side of an envelope according to the invention.
Figure 2:
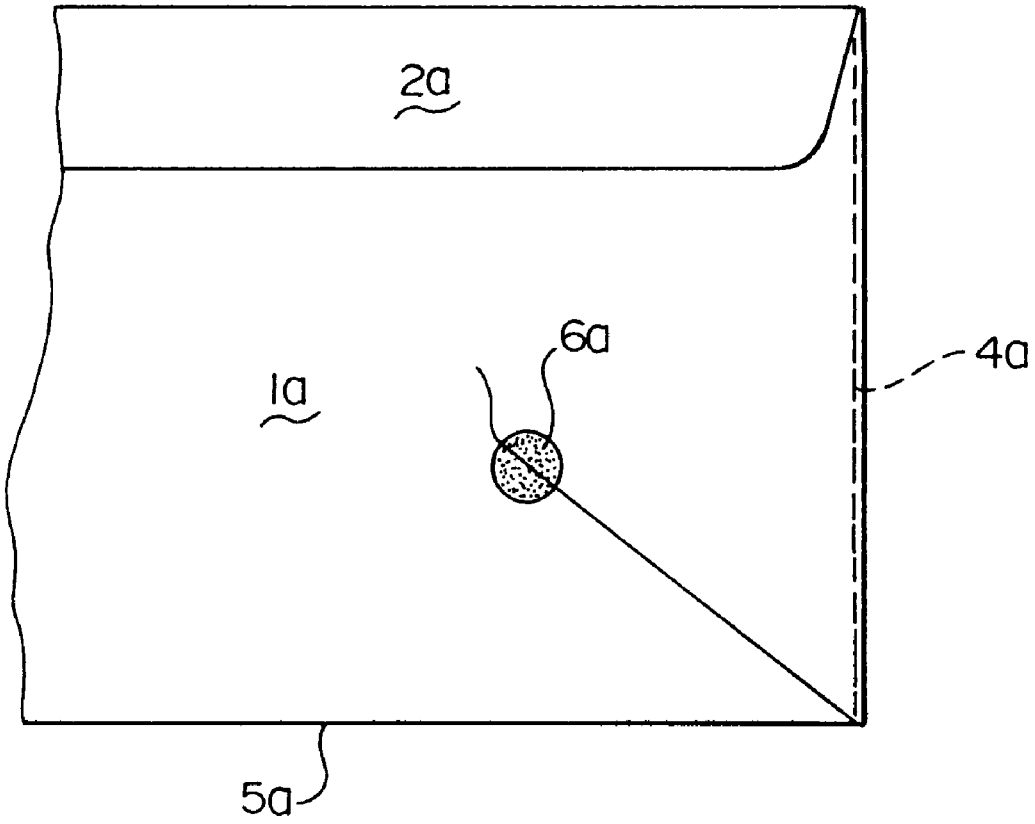
FIG. 2 shows an embodiment in which the string is covered by adhesive tape.

Referring now to FIGS. 1–3, an envelope 1*a* with a gummed closing flap 2*a* comprises adhered side flaps. A cutting string 4*a* is deposited at the inner side of the side edge. This has the advantage that the string can be fed in feeding direction and occasionally can be cut after positioning above the blank. The deposition and attachment of the string thus can be carried out in the course of the manufacture of the envelopes without changing the basic manufacturing steps. The string 4*a* is self-adherent or pressure-sensitive, respectively. It can be impregnated after being unwound from a delivery spool prior to its positioning and cutting. The self-adherent string 4*a,* thus, retains itself in the course of the further manufacturing of the envelope 1*a* and enables a secure attachment whereby the later tearing is facilitated.

The adhesive of the string is selected such that it is not too hard and breaks after cured.

The string 4*a* deposited is very thin so that it does not cause an elevated edge in the area of the string after the manufacturing of the envelope.

The end of the string can be adhered by a chip 6*a* of paper. It can be provided with an advertising printing.

The string 4*a* is impregnated or coated with a suitable adhesive whereby the self-adhering property of string 4*a* is already effective during deposition so that the string can be positioned correctly and retained so that it maintains its position during the further processing of the envelope. In the embodiment shown the blanks for the manufacturing of the envelopes 1*a* are overlapped and fet in a direction which is transverse to the lower or upper edge, respectively. The cutting edge 5*a* of the envolope may include perferorations 7*a* to support the cutting effect of the string.

In order to open the envelope, the short end portion is gripped to release the attachment point 6*a* which serves as a handle to move the cutting string in the plane of the envelope. A movement of the adhesive point and the cutting string in a direction parallel to the cutting edge (5*a*) effects a cutting of the envelope. Owing to the fact that the cutting string 4*a* is fixed up to its end, the envelope can be completely opened. Referring now to FIG. 2, the exposed portion of string 4*a* is covered by adhesive tape 6*b*.

I claim:

1. A tear string envelope, the envelope (1*a*) being made of an integral blank of sheet material and having front and rear portions, the front and rear portions being adhesively interconnected by gummed adhesive region side flaps (3) folded inwardly and defining an upper and a lower edge and side edges as well as leaving an upper insertion opening which can be closed by a gummed closing flap (2*a*), a band (4*a*) coated with an adhesive extending along an inner side of a side edge to form a cutting edge extending perpendicular to that of the closing flap (2*a*), the band being deposited prior to the folding of the flaps, with one end thereof being adhered in the adhesive region of the side flap and with a tear portion extending past the gummed adhesive region side flap (3) and being tautly and adhesively attached to an outside surface of the envelope, characterized in that a band (4*a*) is provided with a thickness smaller than that of the side edge of the envelope (1*a*) and the band (4*a*) is coated with a settable adhesive and deposited tautly such that it is adhesively held on the respective surface of the envelope (1*a*) during further processing of the envelope (1*a*), the attachment being carried out with an adhesive tape which completely covers the exposed portion of the band.

2. The envelope of claim 1, wherein the adhesive costing band remains flexible after curing.

3. The envelope of claim 1, wherein the cutting edge (5) is perforated.

4. A tear string envelope comprising:

an integral blank having front and rear surfaces and top, bottom, left and right edges, the left and right edges forming a flap having a gummed adhesive front surface;

a tear string being coated with a settable adhesive and extending along the front surface of one of the gummed adhesive flaps and with a tear portion extending past the gummed adhesive flap and being tautly and adhesively attached to the rear surface of the blank;

the blank being folded and the front surface interconnected with itself by folding the gummed adhesive flaps inwardly to form an envelope having a upper and lower edges and side edges, and top and bottom sides, the folded blank leaving an upper insertion opening which can be closed by a gummed closing flap, the tear string tear portion being adhesively held on the rear surface of the envelope, which when folded forms the top side of the envelope, whereby the envelope may be opened by tearing the side edge of the envelope with the tear string by pulling on the tear string tear portion, the attachment of the tear string being carried out with an adhesive tape which completely covers the exposed portion of the string.

* * * * *